United States Patent [19]

Rowell

[11] 4,054,972

[45] Oct. 25, 1977

[54] BRASSIERE FASTENER

[76] Inventor: Ross Fredrick Rowell, 5361 Belmore, Montreal, Canada

[21] Appl. No.: 680,712

[22] Filed: Apr. 27, 1976

[51] Int. Cl.[2] ..... A44B 13/00

[52] U.S. Cl. ..... 24/201 HE; 24/225; 24/201 R

[58] Field of Search ..... 24/201 HE, 201 CF, 265 H, 24/225

[56] References Cited

U.S. PATENT DOCUMENTS

| | | | |
|---|---|---|---|
| 1,852,506 | 4/1932 | Dalton | 24/225 |
| 3,077,089 | 2/1963 | Silverman | 24/225 |
| 3,121,931 | 2/1964 | Diaz | 24/225 |
| 3,165,803 | 1/1965 | Gaylord | 24/201 HE |
| 3,426,400 | 2/1969 | Lauro | 24/225 |
| 3,445,901 | 5/1969 | Kamper | 24/201 HE |
| 3,484,907 | 12/1969 | Elsenheimer | 24/206 R |
| 3,837,049 | 9/1974 | Corrado | 24/201 CF |

FOREIGN PATENT DOCUMENTS

| | | | |
|---|---|---|---|
| 50,467 | 9/1966 | Germany | 24/201 HE |

*Primary Examiner*—Bernard A. Gelak

*Attorney, Agent, or Firm*—McFadden, Fincham & Co.

[57] ABSTRACT

The present invention provides a fastener suitable for use in a front fastening brassiere, the fastener being of a simple and sturdy construction and providing minimum separation between the parts to be fastened.

1 Claim, 9 Drawing Figures

BRASSIERE FASTENER

The present invention relates to a fastener and more particularly, relates to a fastener for use in brassieres or like garments.

There have been many proposals in the art with respect to the use of fasteners for joining separable but adjacent areas of garments. In the particular field of brassiere manufacture, for many years a "hook and eye" type of fastener has been employed, particullarly in those brassiere constructions which are intended to be fastened at the back of the wearer.

In more recent times, the manufacture of brassieres which fasten at the front of the wearer has become more prevalent. In this type of manufacture, the conventional hook and eye fastener has not been found satisfactory and accordingly, several different types of fasteners have been proposed and are presently employed in the art. One of the most popular type of fasteners employed at the present time comprises a pair of fastening members utilizing a sliding action; the first member being a male member and having a depressible flexible tongue portion which is engageable with at least one fenestration in the female member.

A second type of fastener currently employed has a first member with a vertically extending groove adapted to receive a vertically extending lug portion of the second member. The third type common in the art is similar to the second type but utilizes a turning motion in order to lock or unlock the same.

Despite the fact that fastening members per se are old in the art and that the manufacture of front-fastening brassieres has been known and used for a number of years, several disadvantages remain to be overcome with respect to the aforedescribed prior art fasteners. Thus, employing the sliding action of the first type gives a fastener having a relatively long separation between the two brassiere cups while generally the art requires that the separation or distance be as small as possible. Furthermore, the strength of such fasteners is not always as high as might be desirable. The second type of member discussed above is advantageous in that a substantial distance between the fastened portions is not required; however, such members, which rely on a frictional fit, are very difficult to manipulate both for fastening and unfastening. The third type of fastener does not require a tight frictional fit as does the second type; however, experience has shown that these fasteners have a tendency to break due to the nature of their construction and operation.

It is, therefore, an object of the present invention to provide a fastener for use in brassiere manufacture, which fasstener does not require a large separation between the left and right brassiere cups, while being easily fastenable and unfastenable, and does not suffer from the problems of breakage.

According to one aspect of the present invention, there is provided a fastener suitable for use in a front fastening brassiere, said fastener comprising first and second fastening members, said first member comprising a frame surrounding an elongated aperture, and a stiffening flange integral with a first side of said frame, said second member comprising a frame surrounding an elongated aperture, a stiffening flange integral with a first side of said frame, a generally U-shaped hook portion having a first arm thereof integral with said second side of said frame and a second arm shorter than said first arm terminating in a spaced-apart relationship with respect to a second side of said frame to form a gap therebetween, said gap being sized to be of a width substantially equal to the width of a second side of said first member, said second arm being of a length greater than the apperture width between said first and second sides of said first hook member.

Reference will now be made to the accompanying drawings illustrating a preferred embodiment of the fastener of the present invention along with the advantages thereof, wherein.

Figure 2:
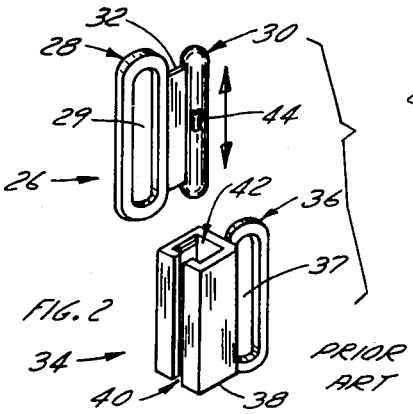
FIG. 2 PRIOR ART
FIG. 2 is a perspective view of a prior art fastener.

Referring initially to FIG. 2, a brassiere type fastener known in the art is illustrated. The fastener includes a male member 26 having a frame 28 surrounding an aperture 29 and a sliding lug portion 30. A relatively thin flange portion 32 extends between frame 28 and lug portion 30.

The female member 34 comprises a frame 36 about an aperture 37, the frame being integral with a body portion 38 surrounding a vertically extending cavity 42. A split 40 is provided in one end wall of body 38.

In operation, lug 30 is adapted to snugly fit within cavity 42, flange 32 being slidable within slit 40. To ensure snugness of fit, frequently one or more projections 44 are provided on lug portion 30.

As will be appreciated, a snug fit between cylindrical portion 30 and cavity 42 is required. However, this snug fit also leads to problems in the removal of male member 26 since, due to the desired narrow width of the fastener as a whole, only frames 28 and 36 may be gripped. In practive, this becomes extremely difficult and the unfastening is tedious at best.

Figure 3A:
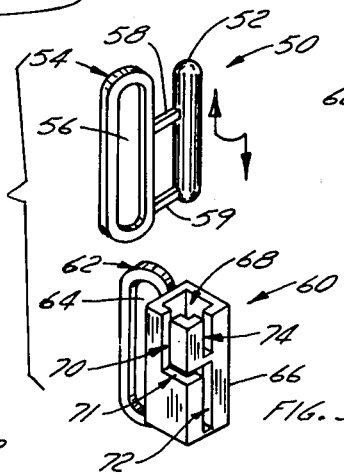
FIGS. 3A and 3B are perspective views of a different type of prior art fastener.
Figure 3B:
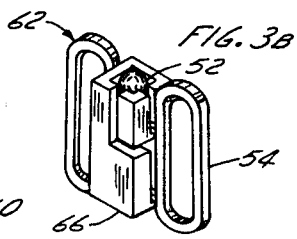
FIG. 3B PRIOR ART

A further type of prior art fastener is illustrated in FIGS. 3A and 3B and which fastener employs some of the principles of the fastener shown in FIG. 2. Thus, the fastener has a male member 50 with a cylindrical portion 52 and a frame 54 surrounding aperture 56; frame 54 and portion 52 being joined by a pair of parallel members 58 and 59.

A female member 60 comprises a frame 62 defining aperature 64 and a body portion 66 surrounding a cavity 68. In the middle of one side wall there is provided a slit 70 extending vertically from an upper end margin to a point approximately halfway down the wall, slit 70 communicating with a horizontally extending slit 71 in the side wall and terminating in an end wall; slit 71 in turn communicates with a second vertical slit 72 in the lower half of the end wall. A further vertically extending slit 74 is provided in the upper half of the end wall, but spaced from slit 72.

In operation, lug portion 52 is inserted in cavity 68 with bar 59 being slidable in slit 70. As may be seen, after insertion, male member 50 must be rotated so that member 59 will follow slit 71 to slit 72 while bar 58 is insertable in slit 74. As may be seen, such a fastener can provide a relatively short distance between the cups of the brassiere to be fastened. The straps are inserted through apertures 64 and 56 secured together by sewing. This type of fastener also provides the problems of a "frictional" fit being required as the fastener will not work loose by itself since a turning action is required to separate the male and female members. While, in theory, the fastener of FIGS. 3A and 3B would seem to be most suitable for use in front-fastening brasieres, in practice it has been found that many consumers try to force the fasteners in engaging and disengaging the same and this leads to breakage of bars 58 and 59. Commercially, this had led to many returns of the garments and consumer dissatisfaction.

A still further type and probably the most commonly used is the "sliding action" fastener wherein the female member has an elongated groove with a pair of fenestrations. The male member employs the resilient tongue portion which is retained in one of the fenestrations; unlocking of the members is achieved by depression of the tongue. However, the separation between the parts to be fastened is a relatively great distance due to the construction of the fastener and as well, the strength is not as high as might be desired.

Turning to FIGS. 4 to 8, one embodiment of a fastener according to the present invention is illustrated therein. Generally, the fastener includes a first fastening member 100 comprising a frame portion formed of a first pair of opposed side walls 102, 104 and a second pair of opposed side walls 106, 108, the side walls defining an aperture 110 surrounded by the frame. Secured to wall 104 of the frame is a "stiffening " flange 112. Preferably, stiffening flange 112 is of a height somewhat less than that of walls 102 and 104.

The second fastening member is generally designated by reference numeral 120 and likewise includes a frame defined by a first pair of opposed side walls 124, 126 connected by walls 130, 132 thus defining an aperture 128 therebetween. A "stiffening" flange 134 is secured to wall 124.

Figure 4:
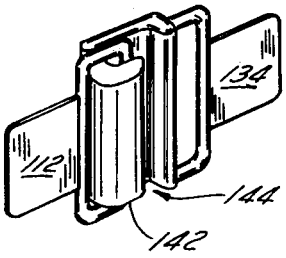
FIG. 4 is a perspective view of an embodiment of a fastener according to the present invention illustrating the two fastener members in a fastened condition.
Figure 6:
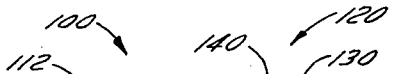
FIG. 6 is a top plan view of FIG. 5.
Figure 5:
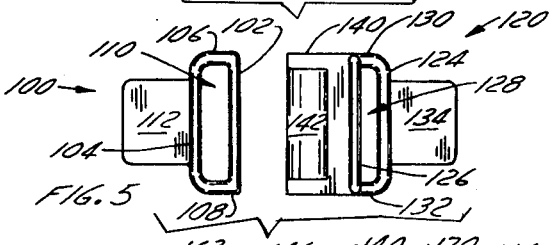
FIG. 5 is a side elevational view of the fastener in an unfastened condition.
Figure 8:
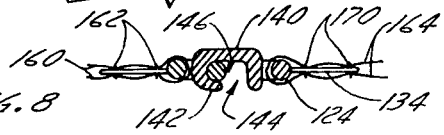
FIG. 8 is a cross-sectional view along the lines 8—8 of FIG. 7.
Figure 7:
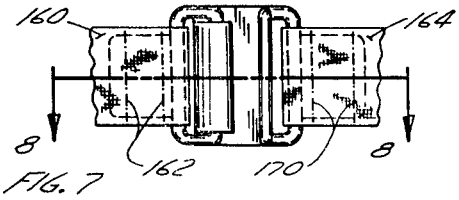
FIG. 7 is a side elevational view of the fastener member in a fastened condition.

The hook portion of the member 120 has a somewhat U-shaped configuration with a first arm 140 of the U-shaped portion being secured to wall 126 and a second arm 142 being "shorter" than arm 140 to form a gap 144 communicating with cavity 146. Preferably, as shown in FIG. 4, the base of the U-shaped hook portion and arm 142 thereof are of a width less than that of arm 140. Furthermore, gap 144 is preferably sized to be of a "width" substantially equal to the thickness of wall 102 of member 100.

For attachment to a brassiere, member 100 is secured thereto by a tape 160 looped through aperture 110 and which tape may then be sewn through flange 112 as indicated by reference numeral 162. Similarly, member 120 has a strap 164 secured thereto by being looped through aperture 128 and then sewn to flange 134 as shown by reference numeral 170. In asembling the members, member 100 is rotated slightly and side 102 is inserted through the gap 144 to enter cavity 146. In this respect, it is preferred that the members be formed of a flexible somewhat resilient material such as a plastic material — i.e. nylon, polypropylene, polyethylene, etc. In the preferred embodiment wherein the width of gap 144 is substantially equal to the thickness of wall 102, or even slightly smaller, the side will be "snapped" through the gap into place.

Preferably, the width of aperture 110 is less than the distance between the interior wall of the base of the U-shaped hook portion and the terminal end of arm 142 such that member 100 cannot be removed through gap 144 without a deliberate rotational movement of the member. In the preferred embodiment illlustrated in the drawings, the frame of member 100 preferably has a height substantially equal to the height of arm 140 of member 120. Similarly, the height of aperture 110 substantially corresponds to the height of arm 142 to give a secure fit. The frame member of member 120 is also preferably substantially co-extensive in height with arm 140.

Figure 1:
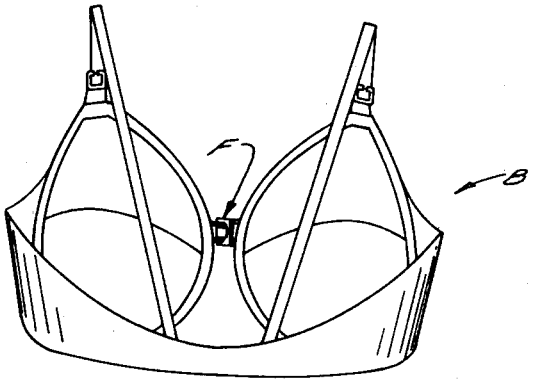
FIG. 1 is a rear view of a brasiere employing a fastener according to the present invention.

The "stiffening" flanges 112 and 134 are useful as means for securing the fastener members to the brassiere and as well, provide a "gripping" means permitting easy locking and unlocking of the fastener. As may be seen in FIG. 1, the fastener generally designated by reference character F as employed in a brassiere B, requires little separation between the brassiere cups.

The above-described fastener obviates many of the problems presented by prior art fasteners. Thus, the distance between the portions to be fastened is minimal while the fastener also permits easy fastening and unfastening. Similarly, it is a sturdy type fastener and is not subject to the breakage problem of the type illustrated in FIGS. 3A and 3B. Preferably, each of the members 100 and 120 is formed of a suitable synthetic plastic material and may easily be formed by injection molding or the like.

While the fastener is intended for the manufacture of brasieres, it will be understood by those skilled in the art that it may easily be employed for garments such as bathing suits or the like.

I claim;

1. A fastener suitable for use in a front fastening brassiere, said fastener comprising first and second fastening members, both formed of a resilient plastic material;

said first fastening member comprising a frame surrounding an elongated aperture adapted to receivve one strap of said brassiere to be passed around a first side of said frame and a first imperforate stiffening flange integral with said first side of said frame, said first stiffening flange being planar and extending outwardly a substantial distnce in the plane of said frame from said first side of said first frame;

said second fastening member comprising a second frame surrounding an elongated aperture adapted to receive a second strap of said brassiere to be passed around a first side of said frame and a second imperforate stiffening flange integral with a first side of said second frame, said second stiffening flange being planar and extending outwardly a substantial distance in the plane of said frame from said first side of said second frame and further including a generally U-shaped hook portion having a first arm thereof integral with a second side of said frame, and a second arm shorter than said first arm terminating in a spaced-apart relationship with respect to said second side of said frame to form a gap therebetween, said gap being sized to be of a width substantially equal to the width of a second side of said first member, said second arm being of a length greater than the aperture width between said first and second sides of said first hook member, both of said stiffening flanges being thinner than the frames with which they are integral and being of a thickness which is penetrable by a means for securing a brassiere strap to each of said stiffening members having an area sufficient to provide a surface for gripping said fastening members between the fingers of a person manipulating said fastener to open or close the same.

* * * * *